US009951685B2

(12) United States Patent
Lawes et al.

(10) Patent No.: US 9,951,685 B2
(45) Date of Patent: Apr. 24, 2018

(54) ROTARY VALVE INTERNAL COMBUSTION ENGINE

(71) Applicant: RCV Engines Limited, Wimborne (GB)

(72) Inventors: Keith Lawes, Poole (GB); Brian Mason, Steyning (GB)

(73) Assignee: RCV ENGINES LIMITED, Wimborne (GB)

( * ) Notice: Subject to any disclaimer, the term of this patent is extended or adjusted under 35 U.S.C. 154(b) by 0 days.

(21) Appl. No.: 14/420,099

(22) PCT Filed: Aug. 6, 2013

(86) PCT No.: PCT/GB2013/000336
§ 371 (c)(1),
(2) Date: Feb. 6, 2015

(87) PCT Pub. No.: WO2014/023929
PCT Pub. Date: Feb. 13, 2014

(65) Prior Publication Data

US 2015/0204235 A1 Jul. 23, 2015

(30) Foreign Application Priority Data

Aug. 10, 2012 (GB) ..... 1214328.5

(51) Int. Cl.
*F01L 7/04* (2006.01)
*F02B 53/04* (2006.01)
(Continued)

(52) U.S. Cl.
CPC ..... *F02B 53/04* (2013.01); *F01L 7/02* (2013.01); *F01L 7/04* (2013.01); *F01L 7/08* (2013.01); *F02B 53/02* (2013.01)

(58) Field of Classification Search
CPC ..... F02B 53/04; F01L 17/02; F01L 17/08
See application file for complete search history.

(56) References Cited

U.S. PATENT DOCUMENTS 1,682,512 A 8/1928 Hays
2,245,743 A 6/1941 Aspin
(Continued)

FOREIGN PATENT DOCUMENTS

DE 4040936 A1 6/1992
DE 4217608 A1 4/1993
(Continued)

OTHER PUBLICATIONS

Shabel et al, "Friction and Wear of Aluminum-Silicon Alloys", ASM Handbook, vol. 18: Friction, Lubrication, and Wear Technology, p. 785-794, 1992.*
(Continued)

*Primary Examiner* — Kevin A Lathers
(74) *Attorney, Agent, or Firm* — Stites & Harbison, PLLC; David W. Nagle, Jr.; Jeffrey A. Haeberlin

(57) ABSTRACT

A rotary valve internal combustion engine has a piston (1) connected to a crankshaft (3) and reciprocatable in a cylinder (2), a combustion chamber 4 being defined in part by the piston. The engine has a rotary valve (5) rotatable with a close sliding fit in a valve housing (8) fixed relative to the cylinder (2), the rotary valve having a valve body containing a volume (9) defining, in part, the combustion chamber 4 and further having in a wall part (11) thereof a port (1)2 giving, during rotation of the valve, fluid communication successively to and from the combustion chamber via inlet and exhaust ports (13), (14) in the valve housing. The rotary valve and the valve housing are both formed of aluminum.

9 Claims, 2 Drawing Sheets

(51) Int. Cl.

| | |
|---|---|
| ***F01L 7/02*** | (2006.01) |
| ***F01L 7/08*** | (2006.01) |
| ***F02B 53/02*** | (2006.01) |

(56) References Cited

U.S. PATENT DOCUMENTS

| | | | | |
|---|---|---|---|---|
| 2,354,305 | A | 7/1944 | Cross | |
| 3,906,922 | A | 9/1975 | Dane, Jr. | |
| 4,494,500 | A | 1/1985 | Hansen | |
| 4,658,776 | A | 4/1987 | Coman | |
| 4,773,364 | A | 9/1988 | Hansen | |
| 4,867,117 | A | 9/1989 | Scalise | |
| 5,474,036 | A | 12/1995 | Hansen | |
| 5,579,730 | A | 12/1996 | Trotter | |
| 5,870,980 | A | 2/1999 | Hooper | |
| 6,321,699 | B1 | 11/2001 | Britton | |
| 7,841,308 | B1 * | 11/2010 | Muth | F01L 7/08 123/190.4 |
| 2002/0046716 | A1 * | 4/2002 | Asai | F01L 3/205 123/73 C |
| 2004/0144361 | A1 * | 7/2004 | Wallis | F01L 1/02 123/347 |

FOREIGN PATENT DOCUMENTS

| | | | |
|---|---|---|---|
| DE | 102008039255 | A1 | 2/2010 |
| EP | 0194041 | A1 | 9/1986 |
| FR | 418427 | A | 12/1910 |
| GB | 190928797 | A | 2/1910 |
| GB | 118244 | A | 8/1918 |
| GB | 292572 | A | 8/1928 |
| GB | 487184 | A | 6/1938 |
| GB | 632573 | A | 11/1949 |
| GB | 859366 | A | 1/1961 |
| GB | 1473107 | A | 5/1977 |
| GB | 2281350 | A | 3/1995 |
| GB | 2438207 | A | 11/2007 |
| GB | 2467947 | A | 8/2010 |
| WO | 97/10417 | A1 | 3/1997 |
| WO | 03/046341 | A1 | 6/2003 |
| WO | 20100069336 | A1 | 6/2010 |

OTHER PUBLICATIONS

UK Intellectual Property Office, Search Report issued in corresponding GB application No. GB1214328.5, dated Dec. 10, 2012.
UK Intellectual Property Office, Search Report issued in corresponding GB application No. GB1117259.0, dated Nov. 29, 2011.
European Patent Office, International Search Report issued in application No. PCT/GB2013/000336, dated Nov. 15, 2013.
The International Bureau of WIPO, International Preliminary Report on Patentability issued in application No. PCT/GB2012/052471, dated Apr. 8, 2014.

* cited by examiner

ROTARY VALVE INTERNAL COMBUSTION ENGINE

The present invention relates to internal combustion engines in which the control of the intake and exhaust of combustion gases is achieved by means of a rotary valve.

Such rotary valves are known, for example in the applicant's co-pending application No. GB 2467947A. Rotary valve engines are known to have problems of sealing as there is a conflict between minimising the clearances between the relatively rotating bodies, which improves efficiency, but runs the increasing risk of overheating and seizing. Being adjacent to the combustion chamber and in fact forming part of the combustion chamber, the valve is subjected to large thermal stresses, high gas pressures and high surface speeds with little or no lubrication. There are thus inherent problems in providing an adequate seal between the port formed in the valve body and the associated valve housing. Conventional rotary valves, which do not contain the volume defining in part the combustion chamber typically use flexible or resilient seals between the rotating valve body and the valve housing, but such seals inevitably have a very short life in the hostile environment and also require the substantial use of lubrication which results in excessive and unacceptable emissions. An example of such a rotary valve is disclosed in U.S. Pat. No. 6,321,699. Attempts have been made for many years to make a commercially acceptable engine utilising rotary valves without seals, notably by Aspin, but these have mostly been unsuccessful principally because of the differential thermal expansion between the valve body and the valve housing. In the prior art, such as DE 4217608 A1 and DE 4040936 A1, this conflict is recognised and attempts to solve the problem are made by providing complex cooling arrangements or simply saying the problem is solved by using suitable materials. In practice, larger than desired clearances are provided to reduce the risk of seizing, at the cost of reducing the efficiency of the engine and increased emissions.

There is an inherent problem in reducing the gap because of the differential thermal expansion between the rotary valve body and the valve housing caused, in part, by the higher temperatures that the rotary valve body reaches compared to the valve housing. This is caused in part by the fact that the valve body is located in the combustion chamber at the point of maximum temperature generation, and also has poorer thermal pathways through which to conduct the heat away to the outside world. In contrast the valve housing has the advantage that it is able to conduct the heat away directly by the provision of external cooling means such as fins or water cooling.

In the past all efforts to solve this problem have been directed to the use of materials having the lowest possible co-efficient of expansion for the valve body to limit its increase in diameter as its temperature increases. This normally involves the use of high grade steels with a hardened surface to minimise wear.

A further drawback of a steel valve body is that steel is a poor conductor of heat. As a result the surface of the valve body tends to get very hot leading to problems with excessive carbonisation.

It is common to use aluminium as the main base material for the valve housing as this makes the engine lighter and also assists in cooling since aluminium is a much better heat conductor than steel. However as the engine gets hot the aluminium of the housing will expand more than the steel of the valve body causing the clearance between the valve body and valve housing to increase, causing gas leakage and loss of power.

To reduce this differential expansion effect sometimes a cast iron, or bronze bush is pushed into the aluminium valve housing. The steel valve body is then run within this bush. This bush further reduce thermal conductivity leading to increased problems with carbonisation. Alternatively the valve body may be run against the aluminium housing, with steel bands embedded within the housing being used to control the expansion of the aluminium. In either case the coefficients of expansion of the body and the housing will still tend not be closely matched. This can lead to problems with seizure if the valve body grows by more than the valve housing, and leakage if it grows by less.

A further disadvantage of the known engines utilising a steel valve body and an aluminium housing occurs in cold conditions. Since the aluminium housing has a greater coefficient of expansion than the steel valve body, it contracts more under cold conditions and it has been found that, particularly at sub-zero temperatures, the gap can disappear altogether with the result that the engine is effectively seized and will not start. To enable cold starting to be achieved, it is necessary to provide a larger gap than is desired for engine efficiency.

The present invention seeks to overcome these disadvantages by using aluminium for the rotary valve body as well as the valve housing, the surface of the aluminium valve body itself acting as the sealing surface, there being no additional sealing devices incorporated within the valve body or valve housing. The use of aluminium for the valve body goes against conventional rotary valve design where the requirement for minimal thermal expansion, and a very hard running surface mean that a hardened steel component is normally used. However it has now been found by experiment that, surprisingly, it is possible to successfully use aluminium for the valve body and that it does overcome the main disadvantages of the steel valve body.

Inherently because the same material is used for both valve body and valve housing, the valve body and housing expand at the same rate. This leads to more consistent sealing across the temperature range from cold starting up to maximum temperature, both reducing leakage when hot, and preventing the engine seizing when cold.

The improved thermal conductivity of the aluminium valve body leads to lower surface temperatures on the valve and reduced carbon deposition.

It has further been found that it is possible to use greater tolerances in the gap between the valve body and the housing than is possible with the existing steel valve bodies without reducing efficiency or increasing the risk of seizing. This greatly facilitates manufacture, particularly for mass production and offers significant savings in manufacturing costs. Typically, it has been found that cold clearances between the valve body and housing of 10-30 microns can be used without significant loss of efficiency, whereas in the known engines clearances in the region of 5-10 microns are needed if efficiency requirements are to be met. In practice, the use of such tight tolerances means that the valve bodies and housings must be individually matched, which is not practical for mass production.

The reason for this surprising advantage is a type of thermal expansion feedback loop in the transmission of heat from the valve body to the valve housing. If clearance between the valve body and the housing increases during running, the heat conduction from the valve to the housing reduces causing the valve body to heat up to reduce the clearance. Similarly, if the clearance reduces, the conduction increases and more heat is conducted to the housing thus reducing the valve body temperature. This self-balancing, correction factor enables the use of the wider tolerance range.

According to the present invention there is provided a rotary valve internal combustion engine having a piston connected to a crankshaft and reciprocatable in a cylinder, a combustion chamber being defined in part by the piston, and a rotary valve rotatable with a close sliding fit in a valve housing fixed relative to the cylinder, the rotary valve having a valve body containing a volume defining, in part, the combustion chamber and further having in a wall part thereof a port giving, during rotation of the valve, fluid communication successively to and from the combustion chamber via inlet and exhaust ports in the valve housing, wherein the rotary valve and the valve housing are formed of aluminium, the sealing function being carried out between a surface of the main body of the rotary valve and a contiguous surface of the valve housing.

Preferably the total sealing function is carried out between the surface of the body of the rotary valve and the surface of the valve housing only, there being no additional sealing devices incorporated within the rotary valve or valve housing.

Preferably, the aluminium is an aluminium alloy with a copper content of up to 5%, and may be a eutectic aluminium. In a preferred embodiment, the interface surface of one or both of the valve body and the valve housing is provided with a hardened surface, which may comprise hard anodised aluminium, a ceramic or silicon carbide coating, a DLC (Diamond like Carbon) coating or a plasma nitrided surface.

In one embodiment, the port in the valve is a recess formed in the lower peripheral edge of the wall of the valve body adjacent to the combustion chamber, the recess extending upwardly from this lower edge of the wall of the valve to form the port in the side of the valve. In another embodiment, the port in the valve is a bore in the wall part of the valve body, the wall having a lip formed below the port adjacent to the combustion chamber.

Preferred embodiments of the present invention will now be described by way of example with reference to the accompanying drawings, in which.

Figure 1:
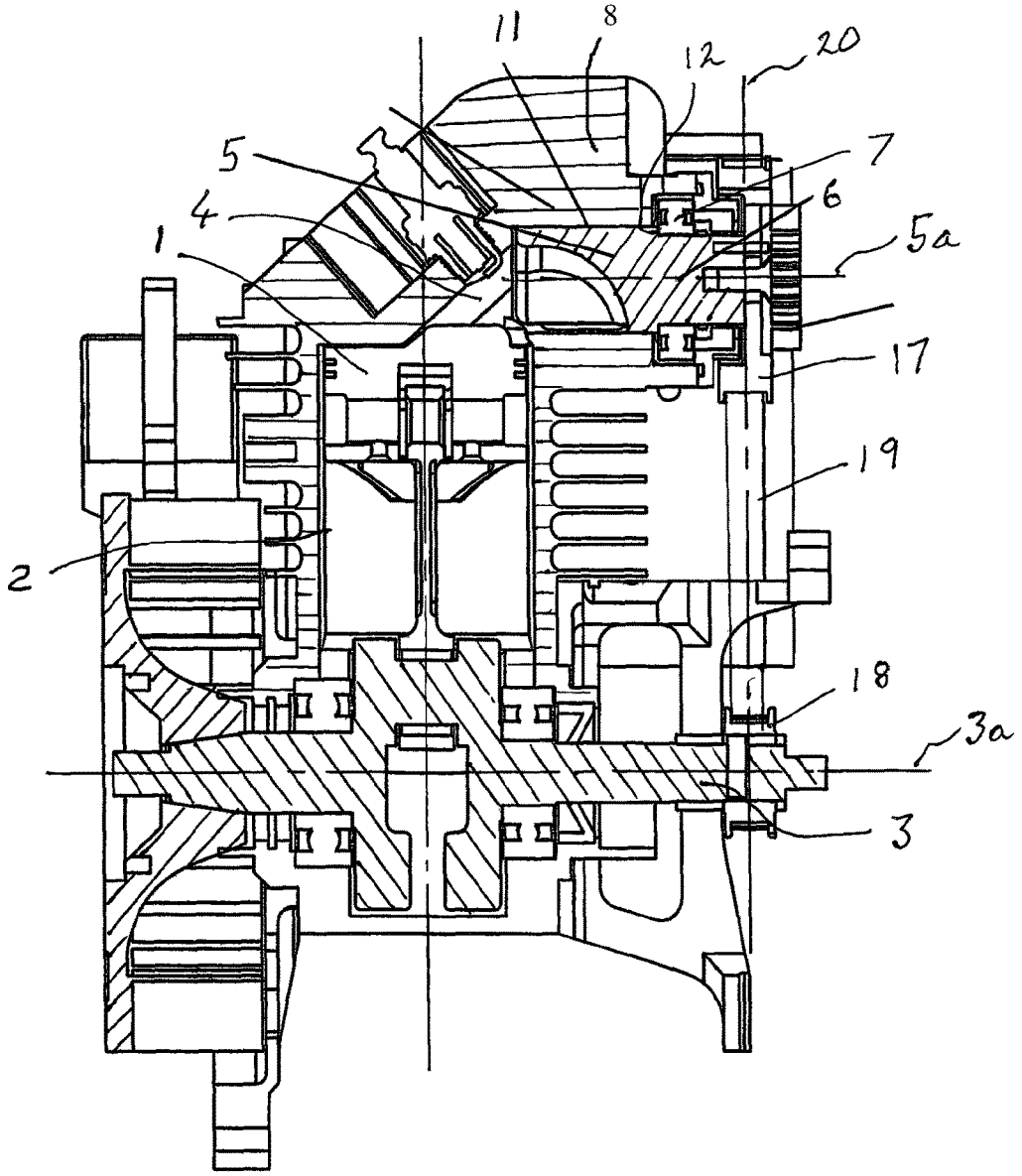
FIG. 1 shows a cross-sectional view of a single cylinder air cooled engine.

Referring now to FIG. 1, there is shown a single cylinder air cooled engine. The cylinder 2 has a piston 1 connected to a crankshaft 3 in the conventional manner for reciprocation in the cylinder 2. As shown particularly in FIG. 2, the upper part of the cylinder 2 is closed by a combustion chamber 4. The flow of inlet air/fuel mix and exhaust gas into and out of the combustion chamber 4 is controlled by a rotary valve 5. In this embodiment, the valve is rotatable in a valve housing in the combustion chamber housing about an axis 5*a* which is parallel to the axis of rotation 3*a* of the crankshaft 3.

At its end remote from the combustion chamber 4, the rotary valve 5 has a driven pulley 17 mounted thereon which is connected to a drive pulley 18 on the engine crankshaft 3 by a belt drive arrangement, comprising an endless belt 19 having a toothed profile on its inner surface which drivingly engage with corresponding teeth on the pulleys 17 and 18. The pulleys, and hence the endless belt 19 also, lie in a common plane 20. Thus, the rotation of the crankshaft 3 and hence the piston movement is coordinated with the rotation of the rotary valve 5 so that the engine operates on the conventional four stroke cycle. To achieve this, the diameter of the driven pulley 17 is twice that of the drive pulley 18 so that the rotary valve 5 rotates at half engine speed.

Figure 2:
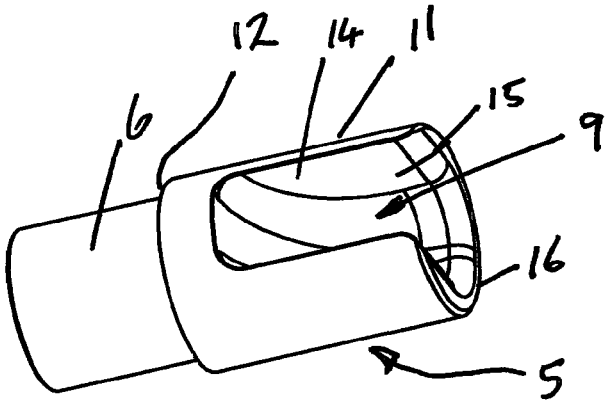
FIG. 2 is a schematic view of one embodiment of the rotary valve body.

Referring now to FIG. 2 also, there is shown more detail of the rotary valve 5. The rotary valve consists of a plain active valve having a first cylindrical part in the form of a shaft 6 mounted on a ball bearing arrangement comprising a single race ball bearing 7, located on a side of the valve 5 remote from the combustion chamber 4. The valve has a slightly larger cylindrical body part comprising the valve body 11 itself which forms a shoulder 12 against which the ball bearing 7 is located. The valve body 11 extends into the combustion chamber and has in its interior a volume 9 which forms part of the combustion chamber 4. The valve body 11 is rotatable in a bore in a valve housing 8 in which the valve body 11 is a close sliding fit. Typically, the clearance is within the range of 10-30 microns between the rotary valve 5 and the bore of the valve housing 8. The valve 5 and the valve housing 8 are formed of aluminium.

Preferably, the aluminium may be an aluminium alloy with a high copper content, up to 5%, which gives good heat dissipation properties and good bearing qualities. A preferred aluminium is that designated as aluminium 2618. In further developments of the invention, one or both of the interface surfaces of the valve body 5 and the valve housing 8 may be provided with a hard coating such as anodised aluminium, a ceramic or silicon carbide coating such as Nikasil (a registered trademark), a DLC (Diamond like Carbon) coating or a plasma nitride treatment.

The shaft 6 part of the rotary valve 5 is only slightly smaller in diameter than the valve body 11 to provide the shoulder. The shaft part is solid to provide a good path for conducting heat from the valve body 11 to the exterior. The shaft, on its end remote from the combustion chamber, to which the driven pulley 17 is connected, may have additional cooling means such as a heat sink 13 which may include fins or a fan rotatable with the driven pulley 17.

The rotary valve, the valve body has a port 14 which, during rotation of the valve, enables fluid communication successively to and from the combustion chamber via inlet and exhaust ports in the valve housing. In this embodiment the port is in the form of a recess formed in the lower peripheral edge 16 of the wall 15 of the valve body adjacent to the combustion chamber the recess extending upwardly from this lower edge of the wall of the valve to form the port 14 in the side of the valve. In an alternative construction (not shown), the port is a bore in the wall part of the valve body, the wall having a lip formed below the port at the lower peripheral edge 16 of the wall 15 adjacent to the combustion chamber.

Although described as a single cylinder engine, it will be understood that the invention is equally applicable to multi cylinder engines which may be of in-line, Vee or horizontally opposed configuration. Furthermore, although described as a spark ignition engine the invention is equally applicable to a compression ignition engine.

Although the example given is for an engine with the axis of rotation of the rotary valve parallel to the axis of the crankshaft, it will be understood that the invention is equally applicable to rotary valve engines where the axis of rotation of the valve is perpendicular to the axis of rotation of the crankshaft, or indeed at any intermediate angle.

The invention claimed is:

1. A rotary valve internal combustion engine comprising:

a piston connected to a crankshaft and reciprocatable in a cylinder, the cylinder having a combustion end;

a combustion chamber being defined in part by the piston and the combustion end of the cylinder, a valve housing fixed at an outer portion of the combustion end of the cylinder and defining a bore, and a rotary valve rotatable about a rotary valve axis with a close sliding fit in the bore in the valve housing, the rotary valve having a hollow valve body having an interior volume forming a part of the combustion chamber wherein the interior volume of the hollow valve body is subjected to combustion gases throughout the combustion process, and further having in a wall part thereof a port giving, during rotation of the valve, fluid communication successively to and from the combustion chamber via inlet and exhaust ports in the valve housing, wherein the base material of both the valve body and valve housing is aluminium, a sealing function being carried out between a surface of the main body of the rotary valve and a contiguous surface of the bore in the valve housing, wherein the sealing function is carried out between the surface of the body of the rotary valve and the surface of the valve housing only, there being no additional sealing devices incorporated between the rotary valve and the valve housing.

2. The rotary valve internal combustion engine according to claim 1, wherein the aluminium is an aluminium alloy with a copper content of up to 5%.

3. The rotary valve internal combustion engine according to claim 1, wherein the aluminium is a eutectic aluminium.

4. The rotary valve internal combustion engine according to claim 1, wherein the interface surface of one or both of the valve body and the valve housing is provided with a hardened surface.

5. The rotary valve internal combustion engine according to claim 4, wherein the hardened surface of the valve body comprises one of: anodised aluminium, a ceramic coating, a silicon carbide coating, a DLC (Diamond like Carbon) coating, or a plasma nitrided surface.

6. The rotary valve internal combustion engine according to claim 4, wherein the hardened surface of the valve housing comprises one of: anodised aluminium, a ceramic coating, a silicon carbide coating, a DLC (Diamond like Carbon) coating, or a plasma nitrided surface.

7. The rotary valve internal combustion engine according to claim 1, wherein the port in the valve is a recess formed in the lower peripheral edge of the wall of the valve body adjacent to the combustion chamber, the recess extending upwardly from this lower edge of the wall of the valve to form the port in the side of the valve.

8. The rotary valve internal combustion engine according to claim 1, wherein the port in the valve is a bore in the wall part of the valve body, the wall having a lip formed below the port adjacent to the combustion chamber.

9. The rotary valve internal combustion engine according to claim 1, wherein there are no thermal expansion restricting devices incorporated between the rotary valve and the valve housing.

* * * * *